United States Patent [19]

Blue

[11] 4,139,667

[45] Feb. 13, 1979

[54] GEMSTONE CLOISONNÉ

[76] Inventor: Joan W. Blue, 1510 Crestview, Seal Beach, Calif. 90740

[21] Appl. No.: 834,801

[22] Filed: Sep. 19, 1977

[51] Int. Cl.[2] ..... B44F 1/06

[52] U.S. Cl. ..... 428/38; 156/63; 428/28; 428/47

[58] Field of Search ..... 428/3, 13, 28, 38, 47, 428/48, 49, 53; 63/1 R, 1 A; 156/63; 40/152.2

[56] References Cited

U.S. PATENT DOCUMENTS

| | | | |
|---|---|---|---|
| 227,377 | 5/1880 | Meyer | 428/67 X |
| 317,077 | 5/1885 | Belcher | 428/38 |
| 587,225 | 7/1897 | Navarein | 428/38 |
| 1,529,831 | 3/1925 | Brennan | 40/28 R |
| 2,778,136 | 1/1957 | Belgard | 63/1 R X |
| 3,025,625 | 3/1962 | Colvin et al. | 428/45 X |
| 3,274,727 | 9/1966 | Zander | 428/49 X |
| 3,846,214 | 11/1974 | Rosenzweig | 428/47 X |

*Primary Examiner*—Henry F. Epstein
*Attorney, Agent, or Firm*—Fulwider, Patton, Rieber, Lee & Utecht

[57] ABSTRACT

An artwork creation is provided in which gemstones are positioned on a laminar backing sheet and are packed within cloisonné framework formed of precious metal. The artistic rendering is composed of discernible parts and articles of jewelry formed of gemstones within boundaries of precious metal which are strategically located upon the backing sheet at positions corresponding to the location of at least some of the dominant features forming these discernible parts. While pieces of mosaic inlay are permanently secured to the backing sheet to form those discernible parts not formed of jewelry pieces, the articles of jewelry are removable from the backing sheet and may be worn for personal adornment. Alternatively, the articles of jewelry are located on the backing sheet at predetermined positions to contribute to the artistic creation.

10 Claims, 13 Drawing Figures

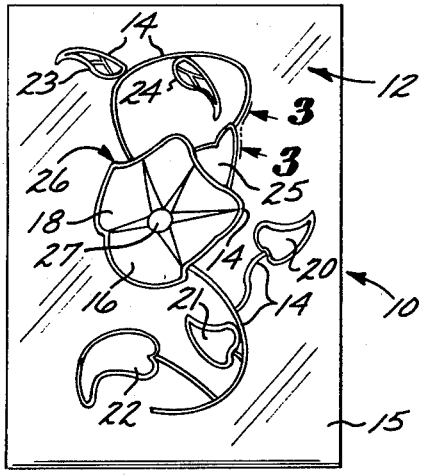
FIG. 1
FIG. 13
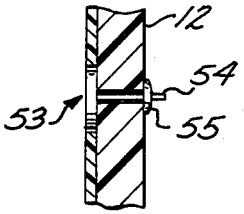
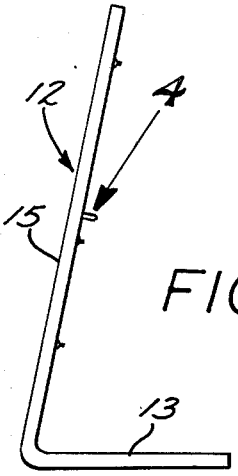
FIG. 2
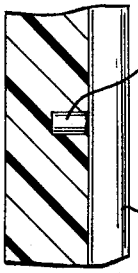
FIG. 3
FIG. 4
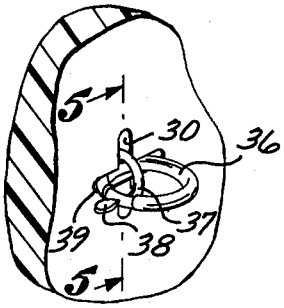
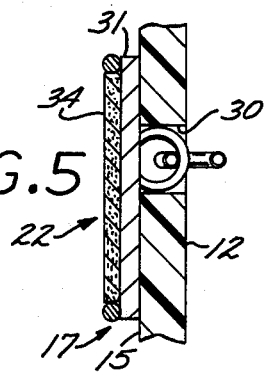
FIG. 5
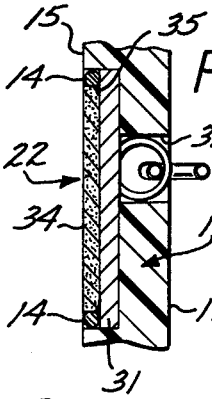
FIG. 6
FIG. 7
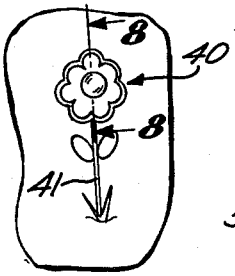
FIG. 8
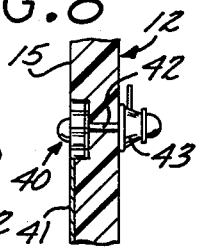
FIG. 12
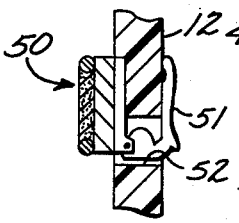
FIG. 9
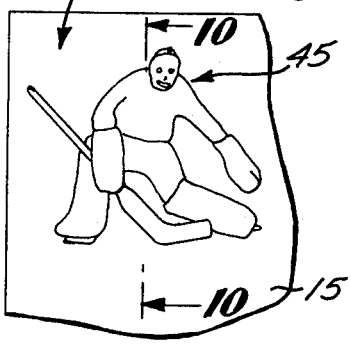
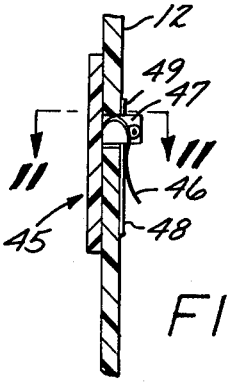
FIG. 10
FIG. 11
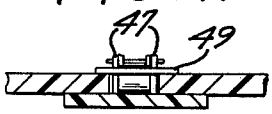

GEMSTONE CLOISONNE

BACKGROUND OF THE INVENTION

1. Field of the Invention

The present invention relates to a form of construction of artistic works and of jewelry for personal adornment.

2. Description of the Prior Art

In the past, artisans skilled in the use of valuable metals and precious and semi-precious gemstones have developed a variety of art forms for effectuating a two dimensional display utilizing three dimensional objects arranged in mosaic fashion. One particular type of such an art form is known as cloisonné, an art form in which colored areas are separated by thin metal bands fixed edgewise to a sheet of backing material. In cloisonne enameled metal or ceramic shapes are assembled together in juxtaposition within the confines of thin metal bands which form boundaries between areas of different colors. In the past, however, cloisonné has been limited to the production of only picture or portrait-like artistic renderings which depict static scenes or objects in fixed settings.

SUMMARY OF THE INVENTION

It is an object of the present invention to provide a cloisonné art form in which portions of the artistic work are not static, but instead are removably positioned within an otherwise fixed setting. The removably positionable portions of the artistic creation are, in fact, constructed with metal bands, clasps or fasteners so that they are useful as jewelry for personal adornment. The removable aesthetically pleasing articles are of such a size, shape and thickness that their detachability from the remaining portion of the cloisonné is not readily apparent to the observer. The articles of jewelry, while frequently forming dominant or particularly attractive portions of the cloisonné, nevertheless contribute to an overall cohesive static artistic rendering when in position proximate to the non-removable portions of the work.

The backing sheet of material upon which the cloisonné is mounted is perforated at stragetic locations to receive the jewelry clasp, pin or other type of fastener by which the articles of jewelry are secured to the clothing or person of the wearer.

A variety of different types of jewelry lend themselves to mounting on a backing sheet of an article of cloisonné artwork. Earrings, brooches, tie tacks, pendants, bolo tie clasps, lapel pins, belt buckles, rings, and numerous other items of jewelry designed for wear on the clothing or person of an individual may be incorporated into cloisonné artwork according to the invention.

A further object of the invention is to provide fine art work in precious and semi-precious stones which may be enjoyed both in a static setting as an integeral part of a cloisonné creation, and also as discrete and separate articles of jewelry for personal adornment. Besides having a particularly favorite piece of jewelry at hand for wear on appropriate occasions, a person is still able to enjoy the article of jewelry in a static setting at other times. Furthermore, not only does the article of jewelry become an integral part of a cloisonné inlay when not worn, but the provision of such an attractive setting for storing the jewelry provides a strong inducement to return articles of jewelry, after wear at certain special occasions, to their appropriate storage places. Because of the unique setting in which the articles of jewelry are stored, misplacement of jewelry and the anquish and frustration associated therewith is greatly minimized by use of the present invention.

Yet an additional object of the invention is the thwarting effect on jewelry theft that the present invention provides. By serving as an integral portion of cloisonné artwork, the jewelry pieces provided pursuant to the invention are easily overlooked by burglars searching for valuable items of jewelry. Thieves are drawn to conventional jewelry storage locations, such as safes, jewelry boxes, dresser drawers, and so forth, rather than to artistic creations. Moreover, burglary attempts are frequently directed at jewelry of the type offering the easiest disposition, such as pendants, brooches, rings and the like, rather than the equally valuable but less familiar forms of artwork in precious or semi-precious gemstones and rare metals.

DESCRIPTION OF THE DRAWINGS

FIG. 1 is a front elevational view showing intact an artistic rendering in gemstone cloisonné according to the present invention.

FIG. 2 is a side elevational view of FIG. 1.

FIG. 3 is a detail at locations indicated at 3 in FIG. 1 of a portion of the cloisonné framework.

FIG. 4 is an enlarged detail of FIG. 2, indicated by the numeral 4 in FIG. 2, showing the manner of attachment of jewelry to a backing sheet according to the invention.

FIG. 5 is a side sectional view taken along the lines 5—5 of FIG. 4 showing mounting of an article of jewelry on a backing sheet.

FIG. 6 illustrates an alternative to the mounting arrangement of FIG. 5.

FIG. 7 is a front elevational detail of an article of jewelry according to the present invention.

FIG. 8 is a side sectional view taken along the lines 8—8 of FIG. 7.

FIG. 9 is a front elevational view of a bolo tie clasp.

FIG. 10 is a side sectional view taken along the lines 10—10 of the bolo tie clasp of FIG. 9 in position on a backing sheet.

FIG. 11 is a sectional plan view taken along the lines 11—11 of FIG. 10.

FIG. 12 is a side sectional view illustrating an additional form of jewelry.

FIG. 13 is a side sectional view illustrating yet a further form of jewelry according to the invention.

DESCRIPTION OF THE EMBODIMENTS

FIG. 1 illustrates a gemstone cloisonné mosaic which is indicated generally at 10 and which is an artistic creation depicting a morning glory vine having discernible parts. A laminar transparent Plexiglas backing sheet 12 or support medium is formed with an upright face 15 and a lower portion which is bent at an angle to form a stand 13. A cloisonné framework at 14 mounted on the backing 12 delineates the boundaries of at least some of the discernible parts, such as the blossoms 25 and 26, the leaves 20, 21, and 22, and the buds 23 and 24 of the morning glory formed in the gemstone cloisonné of FIG. 1. The blossoms 25 and 26, the leaves 20, 21 and 22 and the buds 23 and 24 are discrete piece of mosaic inlay bounded within the cloisonné framework 14 to form an artistic display. In the particular embodiment of the invention depicted in FIG. 1, all of these dominant features, with the exception of the blosssom 25 are articles of jewelry removably situated relative to the face 15 of the plexiglass backing sheet 12 in immobile fashion to contribute to the artistic display of the morning glory. The blossom 26, the leaves 20, 21 and 22, and the buds 23 and 24 are removable from the backing 12 for personal adornment. The blossom 25, on the otherhand, is permanently secured with epoxy glue to the face 15 of the backing sheet 12.

While the removable pieces of jewelry may be formed of any conventional cut and polished stones, gems, precious metals or other adornmental, decorative or embellishing objects, the preferred embodiment of the invention employs semi-precious gemstones as the jewelry centerpieces 34. The morning glory of FIG. 1 has two sets of matching pendants and earrings. One set of earrings with matching pendant includes a large malachite leaf 22 as a pendant with smaller matching earrings formed by the leaves 20 and 21. The other pendant is a turquoise flower 26 which has earring buds 23 and 24 to match. Preferably, the very center 27 of the blossom 26 is a diamond which is removably secured relative to the remainder of the blossom 26. The blossom 26 may be utilized as a single article of jewelry in the form of a pendant, complete with the center 27. Alternatively, however, the diamond, center 27 may be separated from the remainder of the blossom 26 and worn as a discrete item of jewelry alone.

While a wide variety of materials are suitable for use as the mosaic inlay within the cloisonné framework 14, semi-precious gemstones are preferred as providing the most attractive appearance when mounted in the cloisonne artistic rendering 10 and when separated as items of jewelry for personal wear. Some of the semi-precious gemstones which may be used include turquiose, both blue and green, lapiz lazulli in Afganistan royal blue with gold specks and some white matrix or Brazilian lapiz lazulli with no specks of white. Other gemstones include malachite, which is green, white mother of pearl red jasper, black basenite, jade in varying shades of pale green, yellow or gold hickoryite, gold and brown tiger eyes and tiger eyes in hematite, pink botswanas, purple amethysts and purple agates, as well as multicolored agates.

The cloisonné framework 14 may be ⅛ inch (0.32 cm) silver or 14 carat gold rolled from 14 gauge round wire.

In the manufacture of the cloisonné artwork rendering 10, a sheet 12 of Plexiglas 3/16 inches (0.48 cm) in thickness is configured as depicted in FIG. 2 with the face portion 15, depicted in FIGS. 1 and 2, approximately 5 inches (12.7 cm) in width and 7 inches (17.8 cm) in height. Another pleasing dimension for the backing face 15 is 7 inches (17.8 cm) in width by 8 inches (20.3 cm) in height.

The Plexiglas backing 12 is perforated at predetermined strategic locations across its face 15, such as indicated in FIGS. 4–8 and 10–13 for example. The perforations, such as the vertically oriented slot 30 in FIG. 5 extend entirely through the backing sheet 12. In one manner of construction, the articles of jewelry, such as the morning glory leaf 22 depicted in detail in FIG. 5, may be positioned with their mountings 17 arranged so that the jewelry backings 31 lie in contact with the face 15 of the backing sheet 12 to stand out therefrom as indicated in FIG. 5. Alternatively, a recess may be formed in the face 15 of the backing 12 to overlie a perforation in the backing material 12. Such an arrangement is depicted in FIG. 6 and as can be seen, in contrast to the embodiment of FIG. 5, the leaf pendant 22 resides in a recess formed in the face 15 of the Plexiglas sheet 12, rather than atop the face 15. As a result, the exposed surface of the cloisonné artwork constructed according to FIG. 6 lies in a single plane parallel to the face 15 of the Plexiglas backing 12.

To construct the cloisonné artwork rendering 10, the cloisonné framework 14 must be formed. The cloisonné framework 14 is comprised both of portions which are afixed directly to the Plexiblas backing sheet 12, and also portions which are afixed to slabs 31 of the same precious metal of which the framework is constructed to serve as jewelry backings. In both cases, the cloisonné framework 14 stands ⅛ inch (0.32 cm) from the surface to which it is affixed, and may be formed from 14 gauge wound wire of a precious metal such as gold, or sterling silver, rolled to 24 gauge, or to 26 gauge for fine work. Three feet of wire at a time can be rolled in a spring, wired and annealed. Alternatively, platinum wire can be used. For less expensive artistic productions, the cloisonné framework 14 may be formed of copper, aluminum or lead wire, although the precious metals provide a much more satisfactory product and are easier to work with.

It is necessary to form the wire into patterns to form boundaries for the jewelry pieces and also to form the cloisonné for attachment to the Plexiglas 12 to unite the portions of the rendering 10 into a cohesive pattern, such as the morning glory depicted in FIG. 1. To pattern the portions of the cloisonné framework 14, a paper pattern with a tracing indicating the alignment of portions of the cloisonné framework 14 is positioned on firebrick. The rolled precious metal wire is pinned onto the pattern, shaping the wire and cutting it where necessary to preserve the lines of the pattern. The wire should be measured exactly when cutting by using a pointed tweezer to mark the intended cuts. When a very small piece is to be placed on the pattern, it is convenient to hold the small length of wire with tweezers in one hand and push a pin through the wire into the firebrick with the other hand. Once the wire has been pinned onto the pattern, the portions of the cloisonné framework should be fluxed to allow solder to flow. Oxidation should be removed, and joints that are to be soldered should be cleaned. Using solder chips and a poker filed thin on the end , the cloisonné framework 14 is heated, burning up the pattern in the process. One piece of solder at a time is heated and the poker tip is used to pick it up and transfer it to joints in the cloisonné framework 14. The pins holding the cloisonné framework 14 to the firebrick should be removed as soldering progresses.

Once soldered, the cloisonné framework 14 should be freed of all pins and then pickled and rinsed. Rough edges on the inside of the work should be filed and those portions of the cloisonné framework 14 which are to form boundaries for the removable jewelry pieces, such as those depicted in FIG. 1, may be used as patterns to mark the sizes of the semi-precious stones to be utilized in the jewelry. These portions of the framework 14 are then placed on a 24 gauge sheet of the same precious metal of which the framework 14 is formed, and the general area of each backing 31 is cut from this sheet. The portions of the framework 14 to encompass the gems are evened up with a file. These portions of the framework 14 and the sheet jewelry backing sections 31 are then fluxed and thin strips of solder are laid inside all portions of the encompassing frame. The flux is dried with a flame and a poker is used to lift the backings 31, with the framework portions 14 thereon, away from the firebrick so that the frame can applied to the underside of the backings 31 until the solder has flowed to join the portions of the frame 14 to the backings 31 to form encompassing jewelry settings. At this time, any joints of the framework 14 that need to moved are heated so that continuous contact exists between the encompassing framework 14 and the associated backings 31. It is important that all of the outside joints of the framework 14 in the jewelry settings are in contact with the associated backings 31. The settings are then pickled and rinsed.

A jewelers saw is used to cut the backings 31 as close as possible around the outside of the patterned pieces of the coloisonné framework 14 associated with the articles of jewelry, and any protruding edges and sharp angles are filed so that the perimeters of the backings 31 and the portions of the cloisonné framework 14 mounted thereon conform to each other. A fine sanding wheel may be used to remove any file marks and smooth the cloisonné framework edges.

A fastening mechanism, such as a clasp, pin, pendant attachment, jump ring, belt buckle and so forth, is then attached to the back of the setting to form a jewelry mounting 17. The mounting is pickled for about two hours, whereupon it is removed from the pickling liquid and polished with bobbing compound, a heavy grit. Thereafter, the mounting 17 is polished with tripoli, which removes fire scale. Polishing is performed on a soft felt wheel. The mountings 17, depicted in FIGS. 5 and 6, are then ready to receive the gemstones.

In the meantime, the portions of the cloisonné framework 14 which are to be afixed directly to the Plexiglas backing 12 are prepared for fastening. Radial bores are drilled into the wire forming the framework 14 and short wire pegs 19 are inserted therein and solder applied thereto, as indicated in FIG. 3. The mounting pins 19 are of such a diameter as to be received snugly in corresponding drilled bores in the face 15 extending about halfway through the Plexiglas backing 12, as indicated in FIG. 3.

The gemstones 34 for the mosaic inlay are then secured within the cloisonné framework 14 onto the face 14 of the Plexiglas backing 12 and into the mountings 17. The stones 34 are cut in slabs ⅛ inch (0.32 cm) thick although ¼ inch (0.64 cm) thick slabs can be used if desired. The stones 34 are cut as close to the proper size as possible on a trim saw. It is sometimes helpful to draw the actual desired size of the gemstone on the slab before using the trim saw. Each stone 34 is ground to fit its proper channel. For hard stones, a 100 diamond wheel is suitable for grinding, while for soft stones a 600 diamond wheel will suffice. Alternatively, a 220 Carborundum wheel can be used. The underneath edges of the stone are beveled as indicated in FIGS. 5 and 6 at 35 so as to facilate positioning the stones 34 within the cloisonné framework 14. Beveling also provides room for the glue.

The stones 34 and framework 14 are scrubbed to clean out mineral deposits and then are dried. The stones 34 are glued into the mountings 17 or onto the Plexiglas 12 within the cloisonné framework 14 with clear epoxy glue applied with toothpicks. The glue will usually set in 15 minutes under a hot lamp or in a oven at 100° F. (38° C.). The exposed surface of the jewelry is then smoothed using a 100 or 600 grinding wheel, depending upon the stones, until the precious metal wire starts to flatten everywhere. Sanders of fineness ranging from 220 to 400 to 600 are employed to arrive at the appropriate degree of evenness. The final product is then polished. For turquoise, malachite and lapiz lazulli, dry zam is used. For harder stones tin oxide is appropriate. Any glue deposits on the backside of the piece should be filed off and acetone is used to clean off any excess glue from the back. Tripoli followed by red rough is used for shining and for polishing the precious metal framework 14.

The clasp, pin or other mounting piece of each article of jewelry is then inserted through the appropriate perforation in the backing sheet 12, as indicated in FIGS. 4–6, 8, and 10–13. FIG. 4 depicts an appropriate mounting for a pendant in which a spring ring 36 is employed as the means of securing the pendant to a chain or necklace. The aperture 30, as indicated in FIG. 4 is a slot extending entirely through the thickness of the Plexiglas backing sheet 12. A loop 37, secured as the attachment mechanism to the base 31 of the mounting 17 extends into the slot 30 when the leaf pendant 22 is fastened into position on the Plexiglas backing 12. The spring baised lever 38 of the spring ring 36 is then drawn back to allow the spring ring 36 to be inserted through the loop 37. As can be seen in FIGS. 4–6, a shallow channel 39 is formed in the back side of the mounting sheet 12 extending only partially therethrough and in transverse orientation relative to the slot 30. The channel 39 receives the spring ring 36 so that it is held by the loop 37 to bear against the Plexiglas backing 12 within the channel 39 to hold the pendant 22 firmly against the Plexiglas backing 12, either in the position of FIG. 5 with the mounting base 31 flush against the face 15 of the Plexiglas backing 12 or in the position of FIG. 6 in which the mounting 17 lies within a recess in the face 15 of the Plexiglas sheet 12.

Whenever the owner desires to wear the pendant 22, the lever 38 need merely be drawn back to overcome the spring within the spring ring 36 and to allow it to disengage from the loop 37. The pendant 22 can then easily be removed from the face 14 of the backing sheet 12 and worn as an item of personal jewelry. Following use, the spring ring 36 is again disengaged from the loop 37 and the pendant 22 is repositioned on the backing sheet 12 with the loop 37 extending into the slot 30. The spring ring is then opened by drawing back of the lever 38 and positioned in the channel 39 to engage the loop 37. The lever 38 is released and the pendant 22 again becomes an integral part of the gemstone cloisonné artwork rendering 10 of FIG. 1.

The engagement of various types of clasps, pins and other releasable clamping devices and other forms of jewelry are depicted in FIG. 7–13. In FIG. 7, for example, a tie tac 40 is depicted within a cloisonné framework 41. The tie tac 40 is in the form of a flower blossom and may be constructed of any of the foregoing gemstones according to the technique described. The jewelled surface of the tie tac 40 is countersunk into the face 15 of the Plexiglas sheet 12 as indicated in FIG. 8, as is the cloisonné framework 41. The stem 42 of the tie tac pin extends completely through an aperture in the backing sheet 12 and is secured thereto by the compression fastener 43, which is releasably positioned to clamp against the backside of the backing sheet 12 to hold the tie tac 40 firmly in position.

An alternative article of jewelry is depicted in FIG. 9 in the form of a bolo tie clasp having a hockey figure on the face thereof depicted at 45 positioned in contact with the face 15 of the Plexiglas backing 12. To position the bolo tie clasp 45 on the backing sheet 12, the clasp latch 46 is loosened so that it may be inserted through an aperture in the backing sheet 12. The clasp latch 46 is in the shape of a curved tongue mounted about a lateral axis extending between a pair of ears 47 which are perpendicular to the plane of the figure of FIG. 9. The clasp latch 46 is operative to clamp the trailing ends of a bolo tie against the reverse surface of the jewelry piece 45 during use as a tie clasp. When in position on the backing sheet 12, however, a flexible T-shaped plastic retainer 48 is inserted from the top so that the cross piece 49 thereof rests atop the ears 47, as depicted in FIGS. 10 and 11. The retaining piece 49 thereby holds the tie clasp 45 in proper orientation relative to the backing sheet 12. The clasp latch 46 bears against the plastic retainer 48 as it would against the trailing ends of a bolo tie when in position about the neck of wearer.

FIG. 12 illustrates an earring 50 in position on the backing sheet 12 with a spring loaded hinged clamp 51 extending through an aperture 52 therein to hold the earring 50 onto the backing sheet 12. While the earring 50 is designed with a clamp for friction engagement on the ears of the wearer, the earring 53 of FIG. 13 is designed for pierced ears. From the mounting base of the earring 53, a cylindrical stem extends perpendicular to the mounting base and passes through an aperture in the backing sheet 12 and is secured in position thereon by a compression clamp 55 similar to the type of compression clamp used in connection with the tie tac 40 of FIGS. 7 and 8.

While but a few alternative forms of the invention have been illustrated, it must be appreciated that numerous modifications and variations thereof will be readily apparent to those familiar with jewelry and with cloisonné artwork. Accordingly, the present invention should not be considered limited to the particular embodiments depicted herein, but instead is defined in the claims appended hereto.

I claim:

1. A cloisonné mosaic depicting an artistic creation having discernible parts comprised of a laminar backing perforated at predetermined locations, a cloisonné framework mounted on said backing and delineating at least some boundaries of at least some of said discernible parts, and discrete pieces of mosaic inlay packed proximate to said cloisonné framework on one surface of said backing to form an artistic display, at least some of which pieces of mosaic inlay are articles of jewelry removably positioned relative to said cloisonné framework and have releasable fastening means extending through said backing for securing said articles of jewelry to said backing at said perforated locations in immobile fashion to contribute to said artistic display and are releasable to allow removal of said articles from said backing for personal adornment.

2. A cloisonné mosaic according to claim 1 further characterized in that said discrete pieces of mosaic inlay, including said articles of jewelry, are disposed in coplanar relationship when said articles of jewelry are secured to said backing.

3. A cloisonné mosaic according to claim 2 further characterized in that said fastening means include releasable clamping means for holding said articles of jewelry in immobile fashion in position on said laminar backing.

4. A cloisonné mosaic according to claim 3 further characterized in that at least a portion of said fastening means extends through the thickness of said backing material and a portion of said fastening means bears against the reverse surface thereof opposite said mosaic inlay to hold said articles of jewelry immobile in said artistic creation.

5. A cloisonné mosaic according to claim 1 wherein said pieces of mosaic inlay are comprised of gemstones.

6. A cloisonné mosaic according to claim 1 wherein said cloisonne framework is constructed of precious metal.

7. A cloisonné mosaic according to claim 1 further characterized in that said articles of jewelry comprise dominant features of said artistic creation.

8. A cloisonné mosaic according to claim 1 further characterized in that said articles of jewelry are equipped with clasps and said backing material is perforated with apertures at predetermined locations to receive said clasps, and fastening means releasably secure said clasps in said apertures at predetermined locations to hold said articles of jewelry immobile in said artistic creation.

9. A cloisonné mosaic according to claim 1 further characterized in that at least some of said articles of jewelry are removably secured relative to each other and may be utilized as a single article and alternatively separated for use to provide separate articles of jewelry.

10. A cloisonné mosaic according to claim 1 further characterized in that said articles of jewelry include flat backing slabs and a portion of said cloisonne framework is mounted directly on said laminar backing and other portions thereof are mounted on said backing slabs of said jewelry.

* * * * *